US007617884B2

(12) United States Patent
Rubie

(10) Patent No.: US 7,617,884 B2
(45) Date of Patent: Nov. 17, 2009

(54) DRILL SLIDE FOR ROCK DRILLING APPARATUS

(75) Inventor: Peter John Rubie, Toowoomba (AU)

(73) Assignee: RME Underground Pty Ltd (AU)

( * ) Notice: Subject to any disclaimer, the term of this patent is extended or adjusted under 35 U.S.C. 154(b) by 0 days.

(21) Appl. No.: 11/994,219

(22) PCT Filed: Jun. 28, 2006

(86) PCT No.: PCT/AU2006/000912

§ 371 (c)(1),
(2), (4) Date: Feb. 14, 2008

(87) PCT Pub. No.: WO2007/002987

PCT Pub. Date: Jan. 11, 2007

(65) Prior Publication Data

US 2008/0169113 A1 Jul. 17, 2008

(30) Foreign Application Priority Data

Jun. 30, 2005 (AU) ..... 2005903465

(51) Int. Cl.
*E21D 20/00* (2006.01)
*E21B 7/00* (2006.01)

(52) U.S. Cl. ..... 173/11; 173/19; 173/28; 173/152; 173/164

(58) Field of Classification Search ..... 173/4, 173/11, 19, 193, 194, 38, 39, 152, 28, 164, 173/162

See application file for complete search history.

(56) References Cited

U.S. PATENT DOCUMENTS

| | | | | | |
|---|---|---|---|---|---|
| 2,754,087 | A | * | 7/1956 | Johnson | 173/28 |
| 3,020,012 | A | * | 2/1962 | Moracco et al. | 248/654 |
| 3,061,023 | A | * | 10/1962 | Samhammer et al. | 173/37 |
| 3,158,212 | A | * | 11/1964 | Fanshawe et al. | 175/85 |
| 3,384,187 | A | * | 5/1968 | O'Leary | 173/147 |
| 3,470,969 | A | * | 10/1969 | Arcangeli | 173/194 |
| 3,498,375 | A | * | 3/1970 | Donnally et al. | 166/79.1 |
| 3,612,195 | A | * | 10/1971 | Richmond | 175/122 |
| 3,711,047 | A | * | 1/1973 | O'Leary | 248/654 |
| 3,880,244 | A | * | 4/1975 | Boom et al. | 173/19 |
| 3,889,906 | A | * | 6/1975 | Kimber | 248/654 |
| 3,999,805 | A | * | 12/1976 | Lockwood | 299/66 |
| 4,246,973 | A | * | 1/1981 | Mayer | 173/8 |
| 4,501,199 | A | * | 2/1985 | Mashimo et al. | 102/313 |

(Continued)

FOREIGN PATENT DOCUMENTS

CA 2246652 A1 3/2000

(Continued)

*Primary Examiner*—Scott A. Smith
(74) *Attorney, Agent, or Firm*—Daniel B. Schein, Esq.

(57) ABSTRACT

A drill slide (1) for a drilling apparatus, the slide (1) adapted to slidably support a drifter (6), the slide (1) comprising a telescopic shaft (2) having a first elongate member (3) telescopically slidable with respect to a second elongate hollow member (4); a first rail mounted to or integral with the second elongate hollow member (4) upon which the drifter (6) travels along; and wherein a second removable rail (7) is adapted to be fitted adjacent to the first elongate member (3) in an extended configuration, where the second rail (7) is end to end with the first rail (5) thereby allowing the drifter (6) to slide along the first (5) and second rails (7).

5 Claims, 2 Drawing Sheets

U.S. PATENT DOCUMENTS

| | | | | | |
|---|---|---|---|---|---|
| 4,974,686 | A | * | 12/1990 | Hisey et al. | 173/164 |
| 5,131,475 | A | * | 7/1992 | Beney | 173/1 |
| 5,213,169 | A | * | 5/1993 | Heller | 175/122 |
| 5,884,712 | A | * | 3/1999 | Hakkinen | 173/11 |
| 6,497,536 | B1 | * | 12/2002 | Neilson et al. | 405/288 |

FOREIGN PATENT DOCUMENTS

| | | | |
|---|---|---|---|
| FR | 2744489 | A1 | 8/1997 |
| WO | WO 97/01019 | A1 | 1/1997 |

* cited by examiner

DRILL SLIDE FOR ROCK DRILLING APPARATUS

TECHNICAL FIELD

This invention relates to a rock drilling apparatus and method.

This invention has particular but not exclusive application to a rock drilling apparatus and method for use in mine construction, and for illustrative purposes, reference will be made to such application. However, it is to be understood that this invention could be used in other applications, such as general tunnel construction, underpinning and the like.

BACKGROUND

Underground mining of mineral ores, such as coal and hard and soft rock mining requires the developments of underground drives in the form of tunnels. In all hard-rock applications, drive development is achieved through a drilling, charging, blasting, and mucking cycle. In the drilling stage of the cycle, a pattern of holes is drilled into the blind end of the drive. The holes are generally parallel to the drive axis.

In the charging stage, explosive is placed in the drilled holes and connected via a detonating arrangement. In the blasting stage the explosive is detonated, the resulting blast fracturing the solid rock. In the mucking stage a front-end loader digs the fractured rock and removes it for hoisting to the surface via skips. This development cycle is well understood and is currently the most cost effective means of developing drives in hard rock.

An unavoidable consequence of this proven method is rock fracture beyond the desired geometric shape of the tunnel cross-section. This rock fracturing can cause the tunnel roof and/or sidewalls to be unstable. Rock fragments large and small can disengage from the back and sidewalls and fall under the influence of gravity. Particle size ranges from microscopic to cubic meters. Falling particles larger than a tennis ball can prove fatal to personnel.

To protect miners from larger falling particles, a rock bolting/meshing procedure is applied. The process requires drilling holes in the 'back' (walls and overhead), and holding square mesh, typically 50 mm×50 mm to 150 mm×150 mm apertures, against the 'back'. Rock bolts and retaining plates are inserted through the mesh and into the drilled holes. Larger particles are restrained from falling by the rock-bolts and smaller particles are retained or caught by the mesh.

The drill hole depths required for advancement drilling (drilling to extend the length of the tunnel) can be up to 5 meters while drilling in the roof and sides of the tunnel for rock bolts requires a depth of approximately 3 meters. Drilling is generally carried out using a percussive rock drill mounted to a slide. The drill steel (drill bit) is supported at one end by the drifter (drill) and at the other end by a drill guide. For long drill steel, a centre steady is often required. The total length of the drill slide assembly required to drill a 5 meter hole is about 6.5 meters being made up of the drill steel, the drifter, a hose guide spool typically mounted behind the drifter and the drill steadies. Typical mining cross sections range from 3 meters×3 meters to 6 meters×6 meters. It is therefore difficult to use a drill slide mechanism of a set length to drill the advancement holes and the rock bolt holes.

One solution to overcome this is providing two different machines, each fitted with appropriate length sides or alternatively by using a single machine fitted with a split feed. A split feed consists of one slide mounted on another slide allowing the length of the slide to be adjusted. These split feeds are quite complicated mechanisms that require high maintenance and are also mechanically quite complicated and unreliable.

A further prior art embodiment is to use a drill slide that uses a telescoping feed arrangement. This telescopic arrangement wears very rapidly as the sliding surfaces are under load as the elongate telescopic member is jammed against the rock face while the drill is moving. Another problem is that the telescoping elongate member is also at the rock face where all of the ground rock from the holes discharges. This discharging rock rapidly wears the telescope and makes such an arrangement costly and unreliable.

The present invention seeks to provide a drill slide for a drilling apparatus that overcomes at least one of the disadvantages of the prior art.

SUMMARY OF INVENTION

A first aspect of the present invention consists of a drill slide for a drilling apparatus, said slide adapted to slidably support a drifter, said slide comprising a telescopic shaft having a first elongate member telescopically slidable with respect to a second elongate hollow member; a first rail mounted to or integral with said second elongate hollow member upon which said drifter travels along; and wherein a second removable rail is adapted to be fitted adjacent to said first elongate member in an extended configuration, where said second rail is end to end with said first rail thereby allowing said drifter to slide along said first and second rails.

Preferably a drill guide is located at or near the free end of first elongate member, and when said second removable rail is fitted adjacent to said first elongate member it is clamped between said drill guide and said first rail by retraction of said first elongate member.

Preferably said drifter is moved along said first rail by a feed system comprising a feed extension cylinder, and said drifter is moved along said first rail at about twice the rate of speed of said feed extension cylinder.

Preferably said rail guide mechanism is fixed to said feed extension cylinder, and at least one feed rail slides within said rail guide mechanism, and said feed rail supports a centre steady.

Preferably the centre steady is located at or near the midpoint between said drill guide and said drifter in the extended configuration and unextended configuration of said feed system and during movement therebetween.

A second aspect of the present invention consists of a removable rail for a drill slide adapted to slidably support a drifter of a drilling apparatus, said drill slide comprising a fixed rail mounted to or integral with a telescopic shaft, said drifter adapted to slide along said fixed rail when said telescopic shaft is in a retracted configuration, and wherein said removable rail is adapted to be fitted to said telescopic shaft in an end to end relationship with said fixed rail when said telescopic shaft is an extended configuration, thereby allowing said drifter to slide along said fixed rail and said removable rail.

Preferably said removable rail is fitted to said telescopic shaft by clamping it between a drill guide located on the movable free end of said telescopic shaft and said fixed rail.

MODE OF CARRYING OUT THE INVENTION

Figure 1:
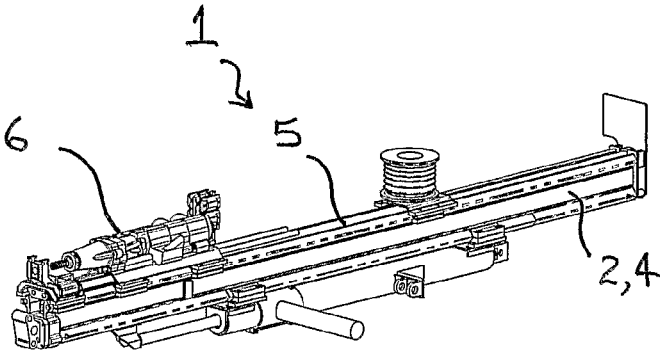
FIG. 1 is a perspective view of a drill slide for a drilling apparatus in accordance with the first embodiment of the present invention with the telescopic elongate member in a fully retracted position.

FIGS. 1 to 7 depict a first embodiment of a drill slide for a drilling apparatus that can be used for both advancement drilling and rock bolt drilling in mining applications.

The drill slide 1 comprises a telescopic shaft 2 having a first elongate member 3 telescopically slidable with respect to an elongate hollow member 4. The first elongate member 3 is actuated by conventional means such as a hydraulic actuator for movement relative to hollow member 4. A first rail (or slide support) 5 is mounted to or integral with elongate hollow member 4. A drifter (drill) 6 is adapted to be slidably supported by first rail 5 for travel in a direction parallel to the longitudinal axis L. A drill guide 8 is located at the free end of first elongate member 3.

Figure 2:
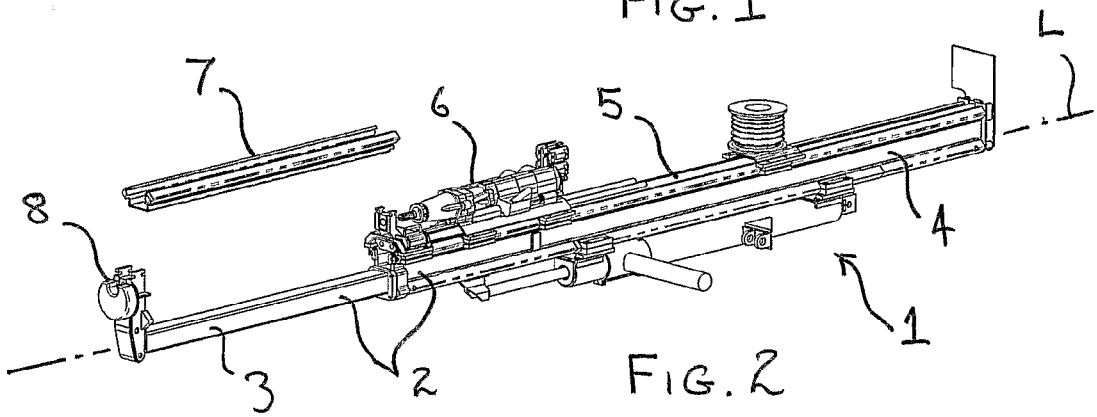
FIG. 2 is an exploded elevational view of the drill slide of FIG. 1 in an extended position and showing a removable rail.
Figure 3:
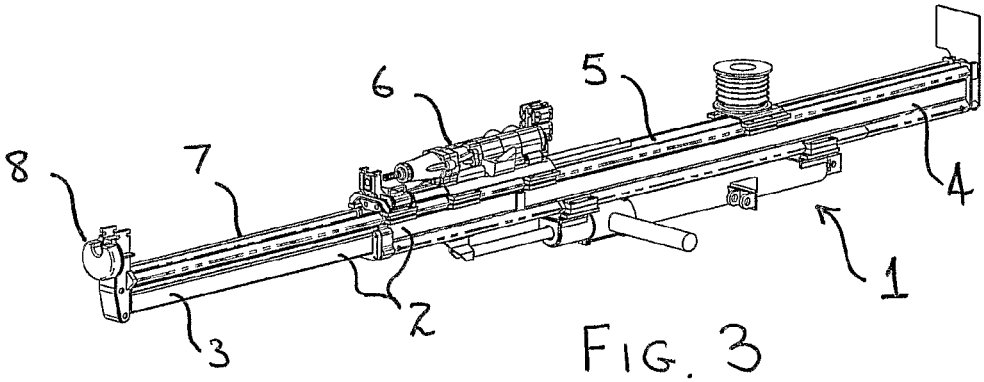
FIG. 3 is a perspective view of the drill slide of FIG. 1 in an extended position and with the removable slide fitted thereto.

As shown in FIG. 2, the first elongate member 3 is telescopically extendible to an extended configuration. In this configuration, a second removable rail 7 is adapted to be fitted lengthwise adjacent to the telescoped first elongate member and positioned between the drill guide (end support) 8 at the free end of the first elongate member 3 and the hollow member 4. As shown in FIG. 3, removable rail 7 is fitted in an end to end relationship with rail 5 such that the drifter 6 may slidably move along both the first rail 5 and the removable rail 7.

In use, to fit the removable rail 7, the telescoping elongate member 3 is fully extended and the rail 7 is dropped into place adjacent the elongate member 3, which is then slightly retracted to lock (or clamp) the rail 7 in place in its end to end relationship with the fixed rail 5. This removable rail 7 ensures that as the drifter 6 slides therealong, it does not cause unnecessary wear to the telescoped elongate member 3. Furthermore, in use of the drill slide 1, the rail 7 can act as a guard from falling rocks and debris thereby protecting the extended telescoping elongate member 3 when it is in the extended position. Furthermore, if rail 7 is damaged during operation, it is far less expensive to replace the removable rail 7 than it is to repair and maintain the telescoping member 3. Furthermore when the lead end of the drill slide 1 is abutted against a rock face (not shown), the rail 7 bears a substantial portion of the load, rather than the elongate member 3.

The drifter 6 is operably moved by a feed cylinder 10, not shown in FIGS. 1 to 3. To more clearly describe the operation of the feed cylinder 10, further reference will be made to schematic FIGS. 4 to 7.

The feed extension cylinder 10 is mounted such that its rod 12 is fixed to the rear of hollow member 4. Two secondary rail guides 13 are fixed to the opposite end of cylinder 10, and two parallel rails 14 slide within these guides 13. One end of these rails 14 is fixed to the drill centre steady 20 and first rail (slide support) 5 which supports the end of cylinder 10 and steadies the drill steel 9. A cable and pulley system (not shown for clarity) is employed, which is common to conventional feed systems, that causes drifter 6 to be moved along first rail 5 at twice the rate of speed of the cylinder 10.

Figure 4:
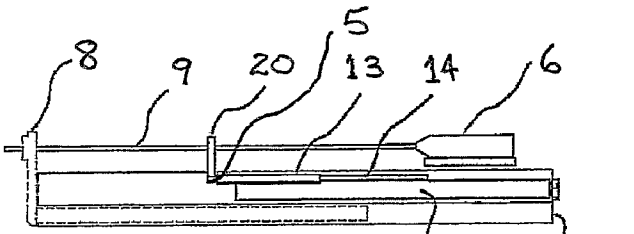
FIGS. 4 and 5 depict schematic elevational views of the feed cylinder operation of the drilling apparatus of FIG. 1 in its short configuration.
Figure 5:
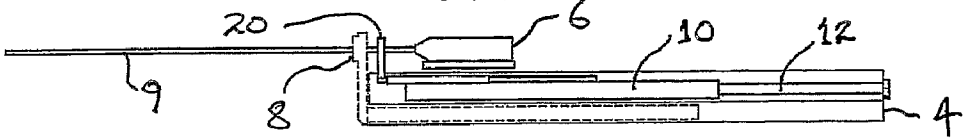
Figure 6:
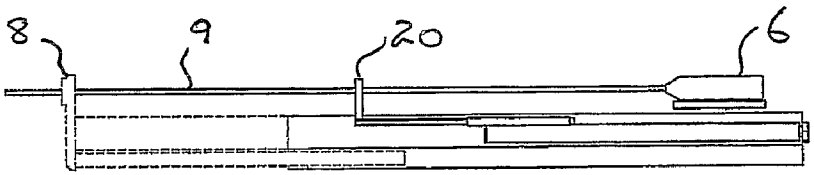
FIGS. 6 and 7 depict schematic elevational views of the feed cylinder operation of the drilling apparatus of FIG. 1 in its long configuration.
Figure 7:
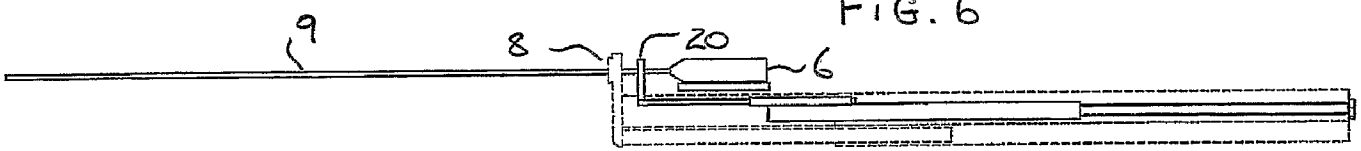

When the feed is in its shortened configuration as shown in FIG. 4, the rails 14, centre steady 20 and first rail (slide support) 5 are retracted and pinned relative to cylinder 10, such that the centre steady 20 is approximately halfway between the drill guide 8 and drifter 6. As the cylinder 10 is extended the centre steady 20 remains at the mid point between the drifter 6 and the drill guide 8 (see FIG. 5).

When the feed is in its long configuration with the second removable rail 7 fitted (see FIGS. 6 and 7), the rails 14, centre steady 20 and first rail (slide support) 5 are extended and pinned such that centre steady 20 is approximately halfway between drill guide 8 and drifter 6. As cylinder 10 is extended the centre steady remains at or near the mid point between drifter 6 and drill guide 8 (see FIG. 7).

In a further not shown embodiment the rails 14 and centre steady 20 are not pinned and are allowed to float between their extended and retracted positions. In such an embodiment the rails 14 and centre steady 20 are constrained to remain between drifter 6 and drill guide 8 by buffers mounted on both drifter 6 and drill guide 8.

In the abovementioned embodiments, the advantage is that the overall length of the drill slide 1 can be varied. When the drill slide of the present invention is in the retracted configuration as shown in FIG. 1, the drilling apparatus can be used for rock bolting, whilst when the drill slide is in the extended configuration as shown in FIG. 3, the slide can be used for advancement drilling.

It should be understood that the feed operation of drifter 6 could in other not shown embodiments employ a feed device or assembly that differs to the feed cylinder 10 that is described above with reference to FIGS. 4 to 7.

The invention claimed is:

1. A drill slide, comprising:

a telescopic shaft having a first elongate member that is telescopically slidable with respect to a hollow second elongate member, thereby allowing said drill slide to be configurably fixed in one of a long configuration and a short configuration;

a first rail, mounted to said second elongate member, upon which a drill travels;

a drill guide located at a free end of said first elongate member; and removable second rail that, in said long configuration, is inserted end to end with said first rail and clamped between said first rail and said drill guide by retraction of said first elongate member, thereby allowing said drill to travel from said first rail to said second rail.

2. The drill slide of claim 1, further comprising:

a feed extension cylinder that moves said drill along said first rail at a speed greater than a speed of extension of said feed extension cylinder.

3. The drill slide of claim 2, further comprising:

a rail guide that is fixed to said feed extension cylinder; and feed rail that slides within said rail guide and supports a center steady.

4. The drill slide of claim 3, wherein said feed rail that supports said center steady moves within said rail guide to maintain said center steady at a position between said drill guide and said drill during travel of said drill along said first rail and said second rail.

5. A removable rail for a drill slide that includes a telescopic shaft having a first elongate member telescopically slidable with respect to a hollow second elongate member, thereby allowing said drill slide to be configurably fixed in one of a long configuration and a short configuration, a first rail mounted to said second elongate member upon which a drill travels, and a drill guide located at a free end of said first elongate member, said removable rail comprising:

a first end that engages said drill guide; and a second end that engages an end of said first rail, wherein said removable rail is clamped, in said long configuration, between said drill guide and said end of said first rail by retracting said first elongate member, thereby allowing said drill to travel from said first rail to said removable rail.

* * * * *